United States Patent [19]

Mort

[11] Patent Number: 4,752,807

[45] Date of Patent: Jun. 21, 1988

[54] APPARATUS FOR ADDING TONER TO AN ELECTROGRAPHIC DEVELOPMENT STATION

[75] Inventor: Thomas W. Mort, Rochester, N.Y.

[73] Assignee: Eastman Kodak Company, Rochester, N.Y.

[21] Appl. No.: 944,105

[22] Filed: Dec. 22, 1986

[51] Int. Cl.[4] ..... B65B 1/04

[52] U.S. Cl. ..... 355/3 DD; 118/653; 118/18; 222/556; 222/DIG. 1; 141/319; 141/346; 141/363; 430/39

[58] Field of Search ..... 355/3 DD; 118/637; 427/18; 222/163, 559, 561, 562, DIG. 1, 556; 141/311 A, 319, 320, 322, 346, 347, 363, 364, 366

[56] References Cited

U.S. PATENT DOCUMENTS

| | | | |
|---|---|---|---|
| 3,409,189 | 11/1968 | McKeand, Jr. | 222/561 X |
| 3,954,331 | 5/1976 | Smith | 355/3 DD |
| 3,981,272 | 9/1976 | Smith et al. | 118/637 |
| 4,062,385 | 12/1977 | Katusha | 141/364 X |
| 4,237,943 | 12/1980 | Ermel et al. | 141/284 |
| 4,274,455 | 6/1981 | Simons | 141/1 |
| 4,344,692 | 8/1982 | Oda | 355/3 DD |
| 4,367,954 | 1/1983 | Ganz et al. | 118/612 X |
| 4,391,503 | 7/1983 | Pugh | 355/3 DD |
| 4,456,154 | 6/1984 | Herriman | 222/559 X |
| 4,491,161 | 1/1985 | Tamura et al. | 141/364 |
| 4,615,364 | 10/1986 | Kawata | 222/DIG. 1 X |

FOREIGN PATENT DOCUMENTS 3326198 1/1985 Fed. Rep. of Germany .

*Primary Examiner*—Patrick R. Salce
*Assistant Examiner*—Emanuel Todd Voeltz
*Attorney, Agent, or Firm*—G. Herman Childress

[57] ABSTRACT

A development station of electrographic apparatus uses particles of toner to develop latent images on a photoconductor. As the toner particles are depleted a new supply of toner from a container is provided to the development station. Apparatus for adding toner to the development station includes a mounting member having an opening through which toner can pass to the station. A cover hinged to the mounting member moves between closed and open positions, and the cover has an opening that is aligned with the opening in the mounting member when the cover is closed. A shut-off slide in the cover has an opening that can be aligned with the opening in the cover. A container of fresh toner is coupled to the slide and moves with the slide between positions wherein the toner is blocked from flowing through the cover and a position wherein toner from the container can move through the slide, the cover and the mounting member into the development station.

7 Claims, 4 Drawing Sheets

APPARATUS FOR ADDING TONER TO AN ELECTROGRAPHIC DEVELOPMENT STATION

BACKGROUND OF THE INVENTION

The present invention relates to apparatus for adding toner to an electrographic development station.

During operation of electrographic apparatus particles of toner from a development station are used to develop a latent electrostatic image on a photoconductor. The toner particles thus depleted from the development station must be periodically replaced using apparatus that is easy for the operator to use, avoids contamination of the electrographic apparatus, and utilizes toner containers that are relatively inexpensive in view of the relatively large quantities of such containers that are used over a period of time.

It is known to provide fresh toner directly from a container to the development station of electrographic apparatus. In some instances the toner is metered to the development apparatus by a toner dispenser between the container and the sump of the development apparatus, and in other instances the full container of toner can be emptied directly into a sump and conveyed to a magnetic brush or the like for applying toner to a photoconductor. Such apparatus is disclosed, for example, in U.S. Pat. Nos. 3,954,331, 3,981,272 and 4,344,692. In other cases the container is placed on the development station and dispensed to the station only after removal of a closure plate or tear strip as disclosed, for example, in U.S. Pat. Nos. 4,237,943 and 4,062,385.

The known apparatus requiring specialized containers having closure plates or tear strips which are removed after the container is mounted on the development station may work well and be clean with little likelihood of contamination of the apparatus. However, because each such container must be provided with a special closure plate or tear strip, they are more expensive than "standard" off the shelf containers. Clearly it would be advantageous to use a standard container. Other of the apparatus disclosed in the patents require movement of parts of the development apparatus, such as a toner metering mechanism, or they may require a relatively large amount of space in the development station. However, it is desirable to minimize movement of parts of the development station when toner is being added, and to minimize the space required for loading fresh toner into a development station. This is especially important when the electrographic apparatus has several development stations for developing images with toners of different colors.

SUMMARY OF THE INVENTION

Accordingly, it is an object of the invention to provide improved apparatus for adding toner to a development station which is easy for the operator to use, clean and cost effective. Another object of the invention is to provide such apparatus which uses "standard" containers, and which requires very little space within the electrographic apparatus. Another object of the invention is to provide apparatus of the type described which is firmly latched in place when a toner container is in a dispensing position to thereby avoid undesirable contamination of the apparatus if the toner supply apparatus is opened inadvertently.

Apparatus of the present invention for adding toner to an electrographic development station comprises a mounting member having an opening therethrough.

The member is mounted with respect to the development station so that toner passing through the opening is delivered to the station. A cover hinged to the mounting member is movable relative to that member between a closed position overlying the opening and an open position spaced from the opening and wherein the cover is substantially inverted relative to its closed position. The cover also has an opening aligned with the opening in the mounting member when the cover is in its closed position. A shut-off slide is carried by the cover for movement relative to the cover between a first position and a second position. The slide has an opening therein that is offset from the opening in the cover when the slide is in its first position, and aligned with the opening in the cover when the slide is in its second position. Means are provided for attaching a container of toner to the slide for movement with the slide. The attaching means has an opening therein communicating with a container on the attaching means and the opening in the slide. When the slide is in its first position toner is blocked from flowing from the container to the development station. When the slide is in its second position toner can pass from the container through the openings in the attaching means, slide, cover and mounting member into the development station.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
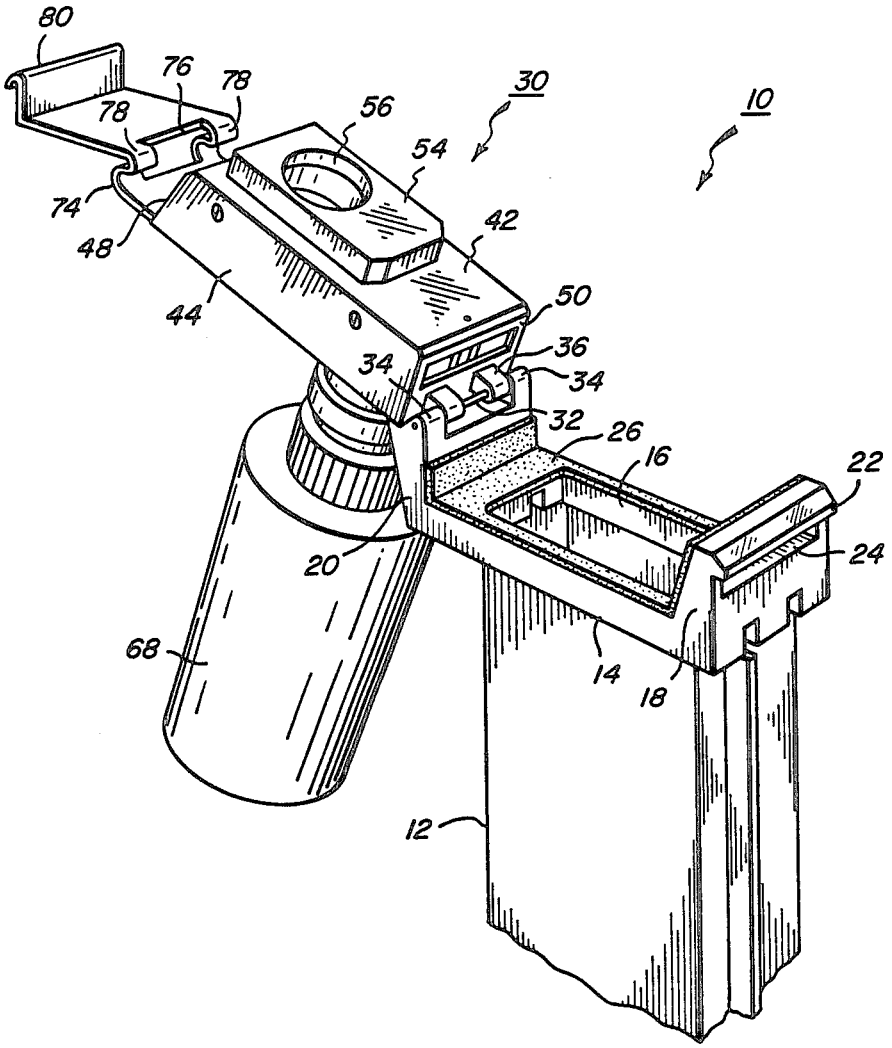
FIG. 1 is a fragmentary perspective view of a portion of a development station of electrographic apparatus and illustrating the apparatus of the invention with the cover in the open position and a toner container attached to the cover.

Referring now to the drawings, the toner adding apparatus of the present invention is generally designated 10 and is useful for providing particles of fresh toner to a development station of an electrographic apparatus. A portion of the replenishment hopper 12 of a development station is illustrated in the drawings.

Secured to the top of hopper 12 is a mouting member 14 having a generally rectangular opening 16 therethrough. The mounting member 14 is secured to the hopper 12 so that toner passing through the opening 16 is delivered through the hopper to the development station.

Figure 3:
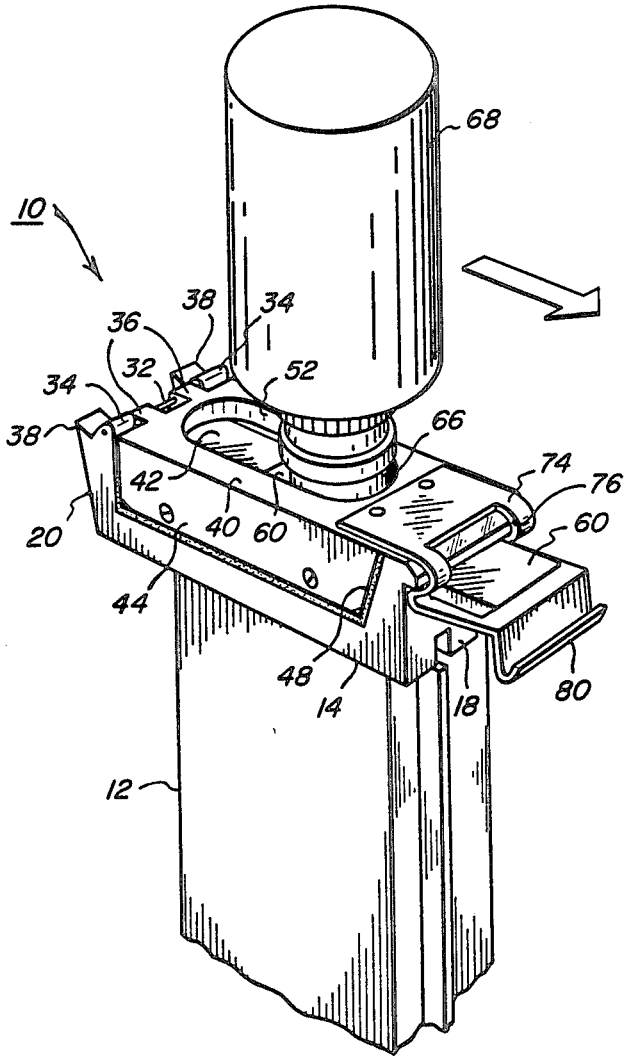
FIG. 3 is a view similar to FIG. 2 but showing the toner container moved to a position for dispensing toner into the station and for latching the cover onto the mounting member.
Figure 4:
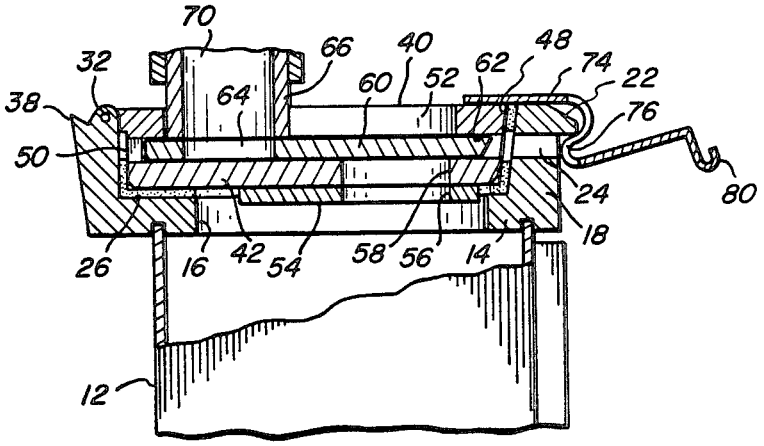
FIG. 4 is a fragmentary cross section showing the apparatus in the position illustrated in FIG. 2.
Figure 5:
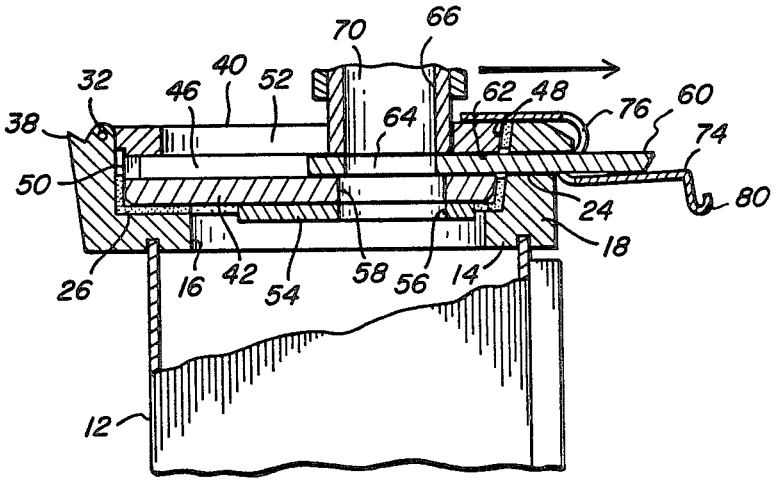
FIG. 5 is a view similar to FIG. 4 showing the apparatus in the FIG. 3 position.

Mounting member 14 has a recessed center portion in which the opening 16 is located, and upwardly projecting end walls 18 and 20 at the ends thereof. A lip 22 projects outwardly from the upper end of the wall 18 and forms part of a latching mechanism described in more detail later. Wall 18 also has an elongate slot 24 that extends substantially the full width of the mounting member in a left or right direction as viewed in FIGS. 1–3. The slot extends completely through the wall 18 from the outer surface thereof to the surface of the wall directly above opening 16, as shown in FIGS. 4 and 5. The slot is just below lip 22. The purpose of slot 24 will be described later.

A foam seal 26 is secured to the upper surface of mounting member 14 and extends completely around the opening 16. Seal 26 also extends completely along the inner surface of wall 18 and a substantial portion of the inner surface of wall 20.

A cover generally designated 30 is pivotally mounted on the mounting member 14 for movement between a closed position and an open position. The cover, when in its closed position, overlies opening 16 and the center portion of the mounting member, as shown in FIGS. 2–5. When in its open position illustrated in FIG. 1, the cover is spaced from the opening 16 and is substantially inverted relative to its closed position. More specifically, the cover is hinged to the mounting member by a hinge pin 32 that extends through spaced ears 34 on the mounting member and ears 36 on an end of the cover. The cover is held in its open position by engagement between a pair of supports 38 at the upper end of wall 20 that are positioned to engage the top wall 40 of the cover when the cover is opened.

Cover 30 also has a bottom wall 42, spaced side walls 44, 46 (FIG. 5) and spaced end walls 48 and 50. Top wall 40 has an elongate slot 52 therein that provides an opening into the hollow interior of the cover. On the bottom wall 42 of the cover there is a block 54 that has an opening 56 extending therethrough. Opening 56 is aligned with a similar opening 58 in bottom wall 42 of the cover, as illustrated in FIGS. 4 and 5. Openings 56, 58 provide a passageway between the interior of the cover and hopper 12 when the cover is closed.

Figure 2:
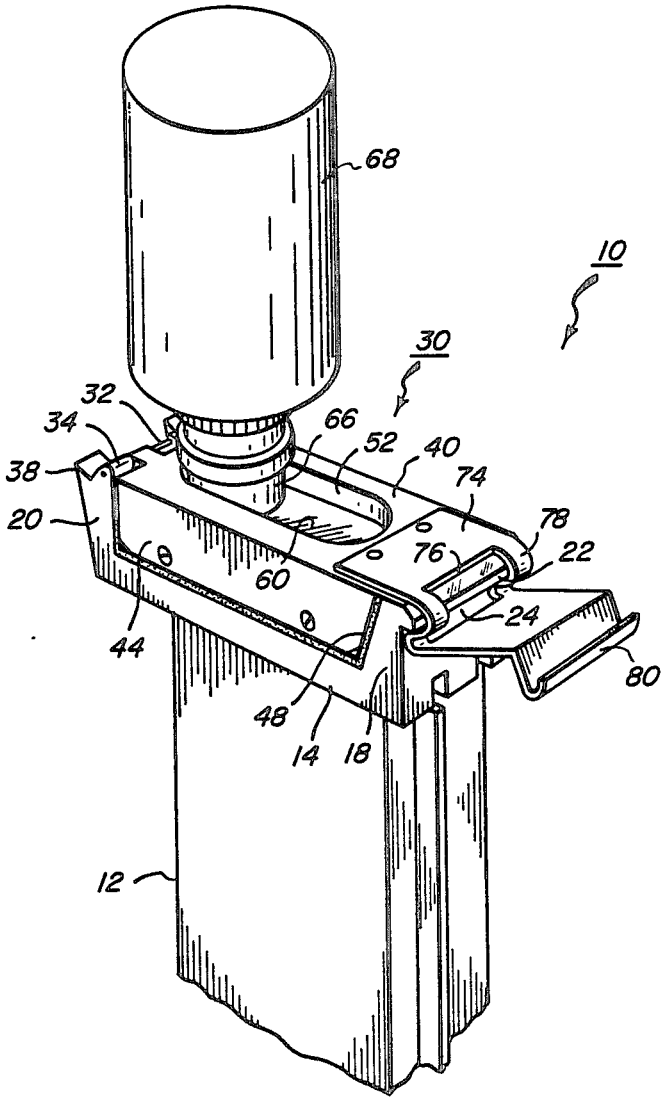
FIG. 2 is a view similar to FIG. 1 but showing the cover in its closed position.

Located within the hollow cover 30 is a shut-off slide 60. The slide is wider than the width of slot 52 in top wall 42 of the cover, as indicated in FIGS. 2 and 3, and also longer than the length of slot 52 as shown in FIGS. 4 and 5. Thus the slide is confined by the walls of the cover but can slide within the space defined by the walls. Slide 60 rests on the bottom wall 42 of the cover and is coplanar with a slot 62 in the end wall 48 of the cover. Slot 62, in turn, is aligned with and coplainer with the slot 24 in wall 18 of the mounting member when the cover is closed. This allows the slide 60 to move between the positions illustrated in FIGS. 4 and 5. Slide 60 has an opening 64 therein which is aligned with openings 56, 58 when the slide is in its FIG. 5 position and offset from those openings when the slide is in its FIG. 4 position.

A coupling 66 is secured to slide 60. The coupling is used for connecting a toner container 68 to the slide. The coupling has a cylindrical opening 70 that provides a passageway communicating with the interior of the container 68 and opening 64 in the slide 60. Preferably coupling 66 has a threaded upper end, as viewed in FIGS. 2–5, so that the container can be easily attached to the coupling by simply screwing it onto the threaded end of the coupling. Thus container 68 can be a standard, off the shelf container, instead of a specially designed container with tear strips, etc., which are expensive to manufacture. Use of such a standard container reduces the cost to the manufacturer and user of the containers. The threaded end of coupling 66 also permits the passageway in the coupling to be closed by a suitable cap (not shown) when a toner container is not on the coupling.

A latch 74 is secured at one end to wall 40 of the cover. The latch has an elongate slot 76 that is aligned with the slot 24 in wall 18 of the mounting member when the cover is in the closed position shown in FIGS. 2–5. The latch has a pair of curved fingers 78 defining the sides of slot 76 which snap over the lip 22 on wall 18 in order to latch the cover in its closed position on the mounting member 14. The latch also has a projecting end portion 80 that can be easily grasped by the machine operator to unlatch the cover from the mounting member 14. Inadvertant unlatching of the cover from the mounting member is prevented by movement of the slide 60 through slots 62, 24 and 76 when the slide is moved from its FIG. 4 to its FIG. 5 position as described hereinafter.

In operation, when it is desired to add toner to the electrographic apparatus through hopper 12 the operator moves coupling 66 and thus slide 60 to the position shown in FIGS. 2 and 4. Then the operator will lift end portion 80 of the latch 74 to release cover 30 from mounting member 14, and swing the cover about hinge pin 32 to the FIG. 1 position. A container 68 loaded with particles of toner for the electrographic apparatus is then attached to the cover by removing the cap (not shown) from the container and screwing it onto the coupling 66. At this time, of course, the container is essentially in an upright position so that particles of toner will not be spilled from the container.

Once a container is secured to the cover, the cover is swung from its FIG. 1 position to its FIG. 2 position. At this time the coupling 66 and slide 60 must be located at their position nearest to end wall 50 of the cover. If they are not in that position the right end of the slide 60 will engage wall 18 of the mounting member and thus prevent the cover from reaching its seated position in the mounting member. When the cover is fully received within the mounting member between walls 18 and 20 of the mounting member, latch 74 is engaged with the lip 22 of the mounting member to thereby secure the cover in position on the mounting member. In order for the latch to reach its closed position the foam seal 26 surrounding opening 16 in the mounting member is slightly compressed to seal the connection between the cover and the mounting member and thereby prevent loss of toner particles from the interface between the cover and the mounting member.

At this time the slide 60 and coupling 66 are located in the position illustrated in FIGS. 2 and 4. Thus toner from container 68 can drop through the coupling passageway 70 and opening 64 of slide 60. However, the lower wall 42 of the cover blocks flow of toner particles from the cover.

Next the operator moves the container from the FIG. 2 position to the FIG. 3 position, thereby effecting movement of the coupling 66 and slide 60 to the position shown in FIG. 5. As this occurs the slide 60 moves through slot 62 in end wall 48 of the cover and slot 24 in end wall 18 of the mounting member, and on through the slot 76 in latch 74. In this position the slide prevents movement of the cover relative to the mounting member and also prevents lifting of the latch 80 to disengage the latch from the lip 22 of the mounting member.

When coupling 66 reaches the right end of slot 52 in top wall 40 of the cover, openings 70 and 64 in the coupling and slide, respectively, are aligned with the openings 58 and 56 in bottom wall 42 of the cover and block 54 to provide a straight passageway directly from container 68 into the hopper 12 of the electrographic apparatus. Toner particles cannot leak between the container and the coupling because the container is tightly screwed onto the coupling. The coupling in turn is rigidly secured to the slide 60 so that no leakage occurs between the coupling and the slide. The slide fits tightly against bottom wall 42 of the cover due to the close fitting relationship between the slide 60 and the top and bottom walls 40, 42 of the cover so that leakage of toner is not likely to occur between the slide and the wall 42. In addition, seal 26 is effective to prevent leakage between the bottom wall 42 of the cover and mounting member 14. Toner drops into hopper 12 through the bottom of opening 58 in block 54, which projects into the mounting member 14 so that toner enters the mounting member below the level of the interface between the cover and mounting member. Thus the apparatus provides a clean, substantially contamination free system for delivering toner particles from the container 68 into the hopper 12.

The double cover latch provided by latch 74 and also by the interconnection between slide 60, wall 18 and latch 74 prevents the operator from lifting the cover from the mounting member without first returning the container and coupling to their positions shown in FIGS. 2 and 4 where the flow of toner particles from the container to the hopper is blocked by the wall 42 of the cover. Thus the operator cannot inadvertently open the cover without first shutting off the passageway between the container and the hopper 12.

After the container is emptied the container and coupling are moved to the position shown in FIGS. 2 and 4, and end portion 80 of the latch 74 is lifted to disengage the latch from the lip 22. The container and cover are then swung from the FIG. 2 position to the FIG. 1 position where the container can be removed and a new container attached to the coupling.

Preferably the apparatus is positioned in the electrographic apparatus so that the lip 22 and slot 24 face the inside of the electrographic apparatus. With this orientation the container 68 is conveniently positioned for the machine operator when it needs to be changed, and very little space is required in the electrographic apparatus. This efficient use of space is especially important in color copiers having several development stations for toners of different colors. Even in this orientation the operator can easily manipulate latch 74 due to the large projecting end portion 80 of the latch. The latch is simple to operate and can be engaged and released without the operator observing its operation.

A number of advantages are achieved by the apparatus of the invention. First of all, addition of toner to the electrographic apparatus is achieved using apparatus that is easy and simple for the operator to use. Secondly, toner can be added without significant contamination of the electrographic apparatus or soiling the clothes or hands of the machine operator. In addition, standard containers as shown at 68 can be used for the toner particles, thus avoiding the need for relatively expensive special containers having closure plates or tear strips sometimes required for electrographic apparatus. Also, the latch and the interlock effected by the slide and related parts insure that the cover cannot be opened when the parts are in a position which would allow toner from an inverted container to flow through the cover and contaminate the electrographic apparatus. These advantages are achieved with apparatus which is relatively simple and inexpensive to manufacture.

While the invention has been described in connection with a preferred embodiment thereof, it will be understood that variations and modifications can be effected within the spirit and scope of the invention as described hereinabove and as defined in the appended claims.

I claim:

1. Apparatus for adding toner to an electrographic development station, the apparatus comprising:

a mounting member having an opening therethrough, the member being mounted with respect to the development station so that toner passing through the opening is delivered to the station, a cover hinged to the mounting member and movable relative to the member between (1) a closed position overlying the opening and (2) an open position spaced from the opening and wherein the cover is substantially inverted relative to its closed position, the cover having an opening aligned with the opening in the mounting member when the cover is in its closed position, a shut-off slide carried by the cover for movement relative to the cover between a first position and a second position, the slide having an opening therein that is offset from the opening in the cover when the slide is in its first position and aligned with the opening in the cover when the slide is in its second position, means secured to the slide for attaching a container of toner to the slide for movement with the slide, the attaching means having an opening therein communicating with a container on the attaching means and the opening in the slide so that (1) when the slide is in its first position toner is blocked from flowing from the container to the development station and (2) when the slide is in its second position toner can travel from the container through the openings in the attaching means, slide, cover and mounting member to the development station.

2. Apparatus as set forth in claim 1 wherein the mounting member has a slot aligned with the slide in the cover when the cover is in its closed position, and a portion of the slide enters the slot when the slide is moved from its first position to its second position to block movement of the cover from its closed position to its open position.

3. Apparatus as set forth in claim 2 further comprising a latch secured to the cover and engageable with the mounting member for holding the cover in its closed position, the latch having a slot therein aligned with the slot in the mounting member when the cover is latched in its closed position, the slide entering the slot in the latch when the slide is moved from its first position to its second position.

4. Apparatus as set forth in claim 1 further comprising a latch secured to the cover and engageable with the mounting member for holding the cover in its closed position, the latch having an elongate slot therein positioned with respect to the slide when the cover is latched in its closed position so that the slide enters the slot as the slide moves from its first position to its second position to block unlatching of the cover from the mounting member.

5. Apparatus as set forth in claim 1 further comprising a seal surrounding the opening on the mounting member and engageable by the cover when the cover is moved to its closed position to seal the interface between the cover and mounting member.

6. Apparatus as set forth in claim 1 wherein a portion of the cover projects through the opening in the mounting member when the cover is in its closed position.

7. Apparatus as set forth in claim 1 wherein the attaching means secured to the slide comprises a coupling having a threaded end portion for attaching a standard container to the apparatus.

* * * * *